US006415963B1

(12) United States Patent
Vlooswijk et al.

(10) Patent No.: US 6,415,963 B1
(45) Date of Patent: Jul. 9, 2002

(54) CONTAINER FOR DISPENSING FLUID, COMPRISING A PRESSURE CONTROL DEVICE WITH ACTIVATION STEP

(75) Inventors: Johannes Jacobus Thomas Vlooswijk, Linschoten; Guido Petrus Johannes van der Klaauw, Zoeterwoude, both of (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/868,280

(22) PCT Filed: Dec. 14, 1999

(86) PCT No.: PCT/NL99/00771

§ 371 (c)(1),
(2), (4) Date: Sep. 7, 2001

(87) PCT Pub. No.: WO00/35774

PCT Pub. Date: Jun. 22, 2000

(30) Foreign Application Priority Data

Dec. 16, 1998 (DE) ..... 298 22 430 U
Aug. 27, 1999 (NL) ..... 1012921

(51) Int. Cl.[7] ..... B65D 83/00
(52) U.S. Cl. ..... 222/396
(58) Field of Search ..... 222/129.1, 145.1, 222/135, 394–399

(56) References Cited

U.S. PATENT DOCUMENTS 4,456,155 A * 6/1984 Miyata et al. ..... 222/396
4,995,533 A * 2/1991 Vandoninck ..... 222/399
5,110,014 A * 5/1992 Doundoulakis ..... 222/396
5,439,137 A 8/1995 Grollier et al.

FOREIGN PATENT DOCUMENTS

EP 0349053 1/1990
FR 2689866 10/1993
FR 2690142 10/1993

* cited by examiner

*Primary Examiner*—William C. Doerrler
*Assistant Examiner*—Thach H. Bui
(74) *Attorney, Agent, or Firm*—Pearne & Gordon LLP

(57) ABSTRACT

A container with pressure device for maintaining a substantially constant, pre-set pressure in the container, which is arranged for dispensing a fluid. The pressure control device comprises a first chamber for containing a pressure fluid, in particular a pressure gas, a second chamber in which, at least during use, a control pressure prevails, and a third chamber which is formed by or is in communication with, at any rate is at least partly included in an inner space of the container. A control means is movable by a displaceable or deformable part of the wall of the second chamber and is arranged for at least partly displacing the closing member when the pressure in the third chamber is lower than the control pressure, such that the pressure fluid can flow under pressure from the first chamber to the third chamber.

11 Claims, 8 Drawing Sheets

CONTAINER FOR DISPENSING FLUID, COMPRISING A PRESSURE CONTROL DEVICE WITH ACTIVATION STEP

This application was published in English on Jun. 22, 2000 as International Publication Number WO 00/35774.

This invention relates to a container of the type described in the preamble of the main claim. Such a container is known from FR-A-2690142.

This known container comprises an inner space in which a fluid to be dispensed is included, in which inner space a pressure vessel is included with pressure control means. In the pressure vessel, a first chamber is formed into which a gas has been introduced under relatively high pressure, while an outflow opening is provided which is closed by a closing member. This closing member is somewhat rod-shaped and is surrounded in the outflow opening by an O-ring in tightly sealing engagement therewith. In the rod-shaped element, a circumferential groove is provided. In the pressure vessel, opposite the first chamber, a second chamber is formed which is closed on the side proximal to the first chamber by a membrane to which the rod-shaped element is attached through one end thereof. In the second chamber, a control pressure has been applied by means of a gas. Between the first and the second chamber, a third chamber is included, through which the rod-shaped element extends and which is provided with an opening which forms a fluid connection between the third chamber and the inner space of the container.

When in this known apparatus in the third chamber a desired pressure prevails, for instance equal to the control pressure, the groove is located in the third chamber and the outflow opening is closed by the rod-shaped element. When fluid is dispensed from the inner space, the pressure therein will decrease, which results in a corresponding pressure decrease in the third chamber. As a result, the membrane-shaped wall part of the second chamber will deform in the direction of the first chamber, thereby moving the rod-shaped element axially, further into the first chamber. When the groove has been moved to the level of the O-ring, gas can escape under pressure from the first chamber via the groove past the O-ring to the third chamber and from there to the inner space of the container. As a result, the pressure in the third chamber rises, such that the membrane-shaped wall part is deformed back, against the control pressure, thereby moving along with it the rod-shaped element from the first chamber. When the rod-shaped element is sealingly embraced again by the O-ring, no gas can escape from the first chamber anymore, in which condition the pressure in the third chamber and in the inner space is approximately equal again to the desired pressure, in this case the control pressure.

This known container has as a disadvantage that already when fitting the pressure control, a control pressure is to be provided in the second chamber, and, moreover, the control means will operate the closing member directly, so that gas will flow out of the first chamber. The reason is that when fitting occurs under normal pressure, the pressure in the third chamber will always be lower than the control pressure in the second chamber. In order to obviate this problem, it has been proposed to mount the pressure control device and fill the container under excess pressure, such that the control pressure is compensated. This, however, is technically complicated and disadvantageous.

The object of the invention is to provide a container of the type described in the preamble, in which the disadvantages mentioned are obviated, while maintaining the advantages thereof. To that end, an apparatus according to the invention is characterized by the features according to claim 1.

In an apparatus according to the present invention, the advantage is achieved that prior to use the control means is at least functionally uncoupled from the closing member. This means that at a pressure in the third chamber which is relatively low with respect to the control pressure, for instance during assembly and filling of the container, movements of the control means will not force the closing member into an opened position. This means that prior to use the closing member will remain closed at all times. Only when a specific activation step is carried out is a functional coupling obtained between the control means and the closing member, such that a control pressure desired during use is obtained in the second chamber and upon decrease of the pressure in the third chamber relative to the control pressure, the closing member can be urged to the open position for the desired pressure fluid, as described in the introduction. The activation step is then to be carried out deliberately in order to set the pressure control into operation.

A pressure control for use in an apparatus according to the present invention further has the advantage that it can be readily stored and transported, without involving the risk that the pressure medium will flow out of the first chamber. Thus, important technical safety advantages and economic advantages are achieved. Moreover, an apparatus according to the present invention can be assembled and filled at normal ambient pressure, which is particularly advantageous, since this permits the use of conventional assembly and filling lines and does not necessitate special pressure provisions.

In a first advantageous elaboration, a container according to the present invention is characterized by the features according to claim 2.

In such an embodiment, in the first position, the control means can move freely relative to the closing member over a selected distance, without the closing member being operated. This means that the volume of the second chamber can vary within selected limits, for instance as a result of a pressure change, without this enabling pressure fluid to escape from the first chamber. Through an activation step, the first and second coupling means can be brought into a coupled second position, such that a change of the volume of the second chamber, in particular an increase thereof, will activate the control means, so that the closing member is operated for at least temporarily clearing the passage opening between the first and third chamber. The container can, for instance, be filled and the pressure control device can be fitted with the coupling means in the first position, so that unwanted release of pressure fluid from the first chamber is prevented, while the container can be made ready for use through the activation step referred to. The activation step can be chosen such that it can be effected by the consumer himself and/or such that it can be carried out by the manufacturer or retailer.

In this embodiment, first and second coupling means are provided which can be brought into a first position in which they are functionally uncoupled, such that the first part can move relatively freely with respect to the second part, without thereby operating the closing member. Only when the first and second coupling means have been brought into a second position, in which they are functionally coupled, can the closing member be moved to an open position by movement of the control means. The activation step then required can, for instance, be obtained by mechanical means, such as the active movement of the first and second part relative to each other, but is preferably obtained in a pneumatic manner by temporarily raising the pressure in the third chamber to above an activation pressure which is preferably at least higher than the control pressure in the second chamber desired during use.

It is preferred that the pressure in the second chamber prior to the activation step is substantially equal to the ambient pressure, at least is approximately equal to 1 bar. This prevents the movable part of the wall from being loaded unduly and protractedly.

The invention further relates to a method for making a container ready for dispensing a fluid under substantially constant pressure, characterized by the features according to claim 6.

With such a method, in a simple manner, a pressure control device can be filled with pressure medium, such as a gas, and subsequently be built together, without involving the risk that pressure fluid flows away undesirably from the first chamber to the environment. In fact, the closing member will keep the first chamber closed at all times, while the control means cannot, at least not yet, open it. Only when the control means have been functionally coupled to the closing member through an activation step can pressure control be provided for by controlled opening and closing of the closing member.

In a first advantageous embodiment, a method according to the present invention is further characterized by the features according to claim 7.

By including the second part in, at least adjacent to, the closing means for the container, and mounting the first part in the container at a slight distance from the second part, they are kept separate in the container prior to use. By further designing the second part to be movable relative to the first part, the pressure control device can be set into operation by coupling the first and second part through the movement referred to. Through cooperation with the closing member, the control means will then provide for the desired internal pressure in the container. In that case, when filling the container, already a pressure can be applied in the inner space, approximately equal to the control pressure in the second chamber. Consequently, prior to the coupling of the first and second part, the control means will be in a neutral position.

In a further advantageous embodiment, a method according to the invention is characterized by the features according to claim 9.

In such an embodiment, the pressure in the inner space of the container is temporarily raised substantially, for instance by introducing an additional amount of pressure gas, in particular $CO_2$, into the headspace of the container, so that the control means are activated and are brought into an actively and functionally coupled position, in communication with the closing member. Since the headspace will normally be relatively small, relatively little gas needs to be additionally introduced, which can be readily absorbed by the beverage, so that the pressure will decrease relatively fast. Thereafter, the opening and closing of the closing member is actively controlled by the pressure control device. It will be clear, incidentally, that it is also possible to obtain the desired pressure increase by reducing the headspace, for instance by deformation of a wall part of the container in the direction of the inner space, or by inflating a balloon-shaped element in the container.

The required activation step can be readily carried out by the manufacturer, for instance by introducing an amount of $CO_2$ or deforming a container wall part directly after filling of the container, during or directly after closure of the container. Also, means may be provided to allow the consumer carry out this activation step, for instance by means of an internal or external gas cartridge, a widget responding to the opening of dispensing means or the like.

As a pressure fluid in an apparatus or method according to the invention, preferably a gas, in particular $CO_2$ or $CO_2$-containing gas, is utilized. However, a different pressure fluid can also be used, for instance a liquid. A pressure fluid can also be obtained in a chemical manner, for instance by bringing together calcium, (bi)carbonate and an acid such as citric acid. Thus, a pressure gas, in particular $CO_2$, is obtained. Many variations thereof are possible. In this connection, for instance the (bi)carbonate or other calciferous product can be stored in the third chamber, at least on the opposite side of the closing member.

Further advantageous embodiments of a container and method according to the invention are set forth in the further dependent claims.

To clarify the invention, exemplary embodiments of a container, pressure control device and method will be further explained with reference to the drawings. In the drawings:

FIG. 1 schematically shows in sectional side elevation a container with pressure control device according to the present invention;

FIG. 2 schematically shows in sectional side elevation the general construction of a pressure control device for use in the invention;

FIGS. 3A and B show a detail of a container according to the present invention with a portion of a pressure control device, in uncoupled condition in FIG. 3A and in coupled, ready-for-use condition in FIG. 3B;

Figure 1:
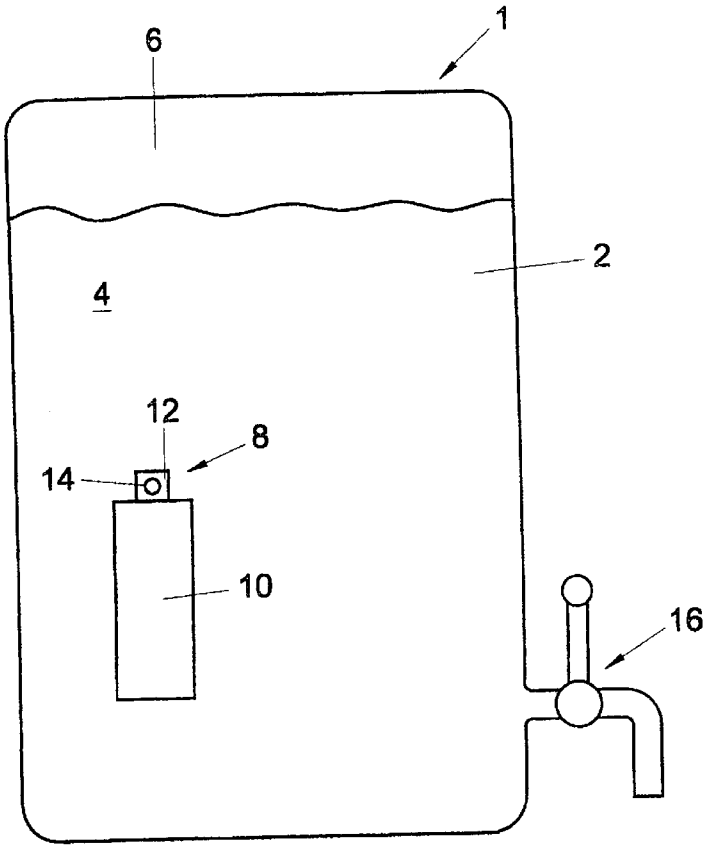

FIG. 1 shows, in a highly schematic form in a sectional side elevation, a container 1, in the form of a substantially cylinder-shaped can in which beverage 2 is included in the inner space 4. In the container 1, a headspace 6 can be present, for instance filled with carbonic acid gas. In the container 1, further, a pressure control device 8 is included, which comprises a pressure vessel 10, a valve assembly 12 and an outlet opening 14. In the pressure vessel 10, in a manner to be further described hereinafter, a gas is stored under relatively high pressure. By means of the valve assembly 12, in a manner to be further described hereinafter, gas can be introduced from the pressure vessel 10 via the pressure control device 8 into the inner space 4 of the container 1 for controlling the pressure therein. In the embodiment shown in FIG. 1, in the sidewall of the container 1, a tap 16 is arranged, with which beverage 2 can be discharged from the inner space 4.

Figure 2:
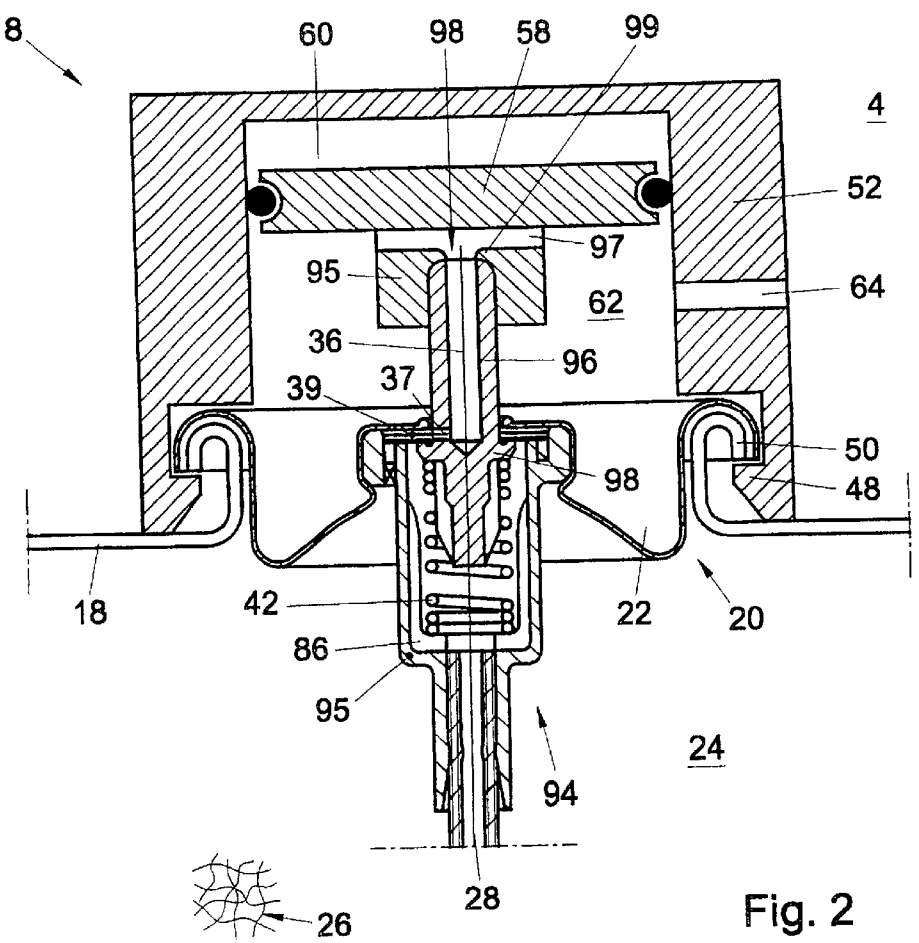

In FIG. 2, in sectional side elevation, a portion of a pressure control device 8 is shown, as described in more detail in the Dutch patent application filed on the same date, entitled "Container with pressure control device for dispensing fluid". This embodiment is described to illustrate the general principle of operation of such a pressure control device 8.

In this embodiment, the pressure control device 8 comprises a first housing 18, an intermediate part 22 and a second housing 52. In the intermediate part 22, a valve 94 is included of the type conventionally utilized in spray cans such as aerosol containers and the like. Such a valve is known from practice. In FIG. 2, a suitable embodiment of a valve 94 is shown, but it will be clear that other types of valves can also be used in a pressure control device according to the present invention. Thus, for instance, female valves or tilting valves can be used instead of the male valve shown. In the embodiment shown, the valve 94 comprises a third housing 95, fixedly connected with the intermediate part 22, having therein a fourth chamber 86 in which a compression spring 42 is accommodated by way of biasing means. The valve is thereby biased into the closed position. A rod-shaped element 96 is confined, through a collar 98, between the coupling part 22 and the upper end of the spring 42 and extends to a point outside the coupling part 22. In the part located outside the coupling part 22, an axial bore 36 is provided in the form of a blind hole. Provided above the collar 98 is a radial bore 37, which terminates in the axial bore 36. In the position shown, the radial bore 37 is closed by a sealing ring 39 in the intermediate part 22. On the intermediate part 22, the second housing 52 is mounted with suitable snap means 48, 50. Inside the second housing 52, a second chamber 60 is separated from a third chamber 62 by an axially displaceable piston 58. The third chamber 62 is in communication with the inner space 4 of the container 1 via an outflow opening 64. At the underside of the piston 58, a cylindrical part 95 is formed with an axial bore 98 which can be secured with a proper fit over the upper end of the rod-shaped element 96. On the side proximal to the piston 58, a collar 99 is provided in the axial bore 98, which is supported against the upper end of the rod-shaped element 96. From the axial bore 98, radial bores 97 extend, which bring the axial bore 98 into fluid communication with the third chamber 62.

As is described in more detail in the above-mentioned Dutch patent application of the same date, in the second chamber 60 a control pressure is applied, such that upon a decrease of the pressure in the third chamber 62 and the inner space 4 to below a minimum desired pressure, the volume of the chamber 60 will be increased, at least the piston 58 will be displaced, such that the rod-shaped element 96 will move down, against the spring pressure of the spring 42, in the direction of the first chamber 24. A fluid communication is thereby obtained between the first chamber 24 and the third chamber 62 via the passage opening 28, the fourth chamber 86, the radial bore 37, the axial bores 36, 98 and the radial bores 97.

In the first chamber, a suitable amount of pressure medium, in particular gas such as $CO_2$, is stored under excess pressure. Within the first housing 18, the first chamber 24 is preferably largely filled with activated carbon, for instance activated carbon fiber 26 having a high adsorption and absorption power for the pressure gas referred to, in particular $CO_2$ or a $CO_2$ containing gas. As a result, a particularly large amount of the pressure gas can be charged to the first chamber 24 in proportion to the pressure thereby obtained. This provides the advantage that the first chamber 24 can be relatively small and yet contain sufficient gas. Such use of activated carbon is described in applicant's previously filed Dutch patent application 1009654, which application is understood to be incorporated herein by reference.

Instead of or in addition to the $CO_2$, a different pressure fluid may be included in the first chamber, for instance a liquid under pressure. Also, optionally, a reactive substance may be included in the first chamber, capable of reacting with a second reactive substance to form a pressure medium such as $CO_2$. These may be, for instance, an acid and a calcium product, such as citric acid and (bi)carbonate, while the second reactive component may be stored in the first chamber and reacts only upon a pressure decrease, or in the third chamber, at least on the side of the closing member remote from the first chamber. In that case, the reaction between components does not take place until the closing member is temporarily controlled into the open position upon a pressure decrease in the inner space of the container and the components are brought together or undergo sufficient pressure change to form the desired gas. other reactions too may be suitably employed, to be selected depending on, inter alia, the medium to be dispensed.

When the above-described fluid communication between the first chamber 24 and the third chamber 62 has been formed, gas will flow away under pressure and flow via the passage opening 64 to the inner space 4 of the container, thereby increasing the pressure prevailing therein. Moreover, the pressure in the third chamber 62 will be raised, so that the piston 58 is moved back up, thereby increasing the pressure in the second chamber 60 becoming smaller, until the rod-shaped element has moved back into the position shown in FIG. 2 and the radial opening 37 is closed by the ring 39. With such a pressure control device, therefore, a desired pressure in the inner space 4 of the container 2 will be maintained continuously. Indeed, if fluid is discharged from the container, the pressure in the inner space 4 and the third chamber 62 will decrease and the piston will move down for the purpose of the pressure regulation described above.

In the embodiment shown, the piston 58 is coupled to the rod-shaped element 96 when the second housing 52 is coupled to the first housing 18. This immediately yields an active, functional coupling between the piston 58 and the valve 94. This means that when the assembly then formed is not stored and assembled under a sufficiently high ambient pressure, the valve 94 will be immediately controlled to open and gas will flow away from the first chamber 24 to the environment.

To obviate this disadvantage, it is proposed, according to the present invention, to functionally uncouple the piston 58 or comparable control means from the valve 94 or comparable closing member and to effect such functional coupling only after an activation step. Referring to FIGS. 3–12, a number of exemplary embodiments of such control devices with activation step will be described, it being noted that the control means used therein can also be designed differently, for instance as shown in the above-mentioned Dutch patent application of the same date, filed by applicant.

In FIG. 3, a portion of an advantageous embodiment of a container 101 according to the invention is shown, in cross-section, with a portion of a pressure control device, for instance as shown in FIGS. 1 and 2. It will be clear, incidentally, that in a container 101, other embodiments of a pressure control device according to the present invention can be utilized as well.

Figure 3B:
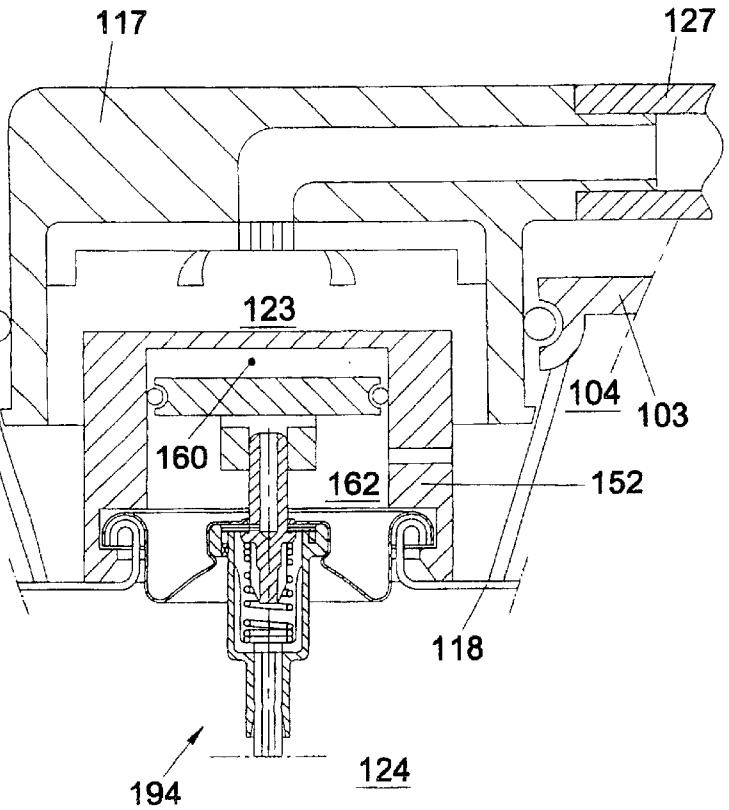
Figure 3A:
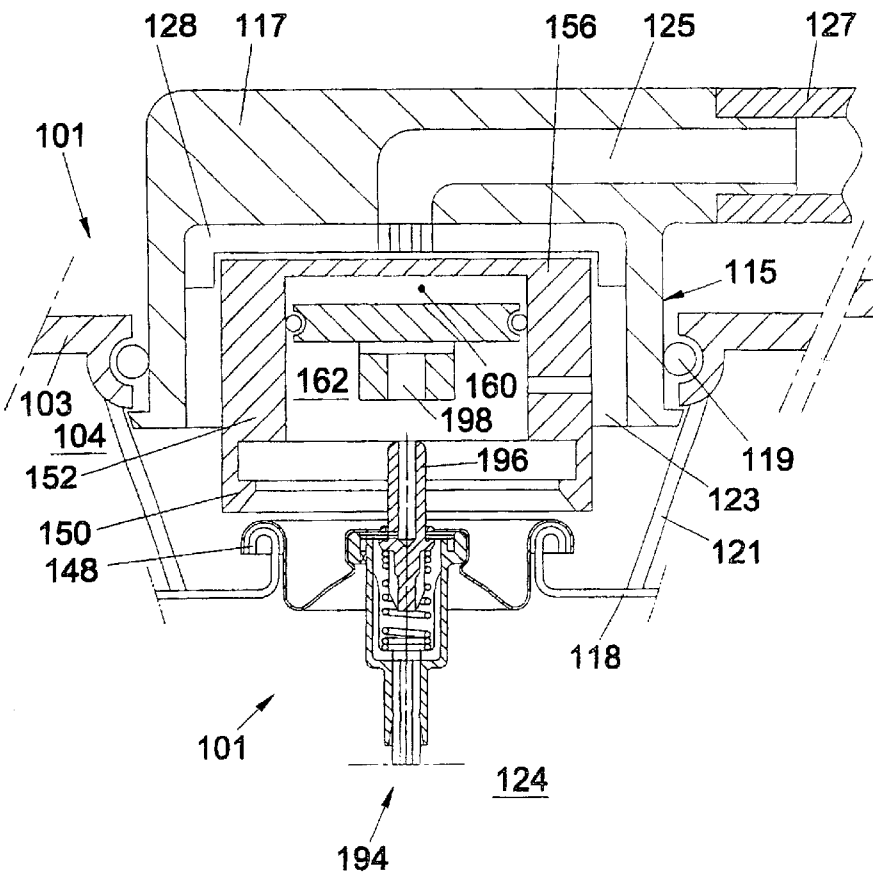

In FIG. 3A, a portion of the wall 103 of a container 101 is shown, with an opening 115 therein, in which a movable closing means 117 is received, in sealing engagement with a rubber ring 119 or like sealing element. At some distance below the opening 115, by means of suitable suspension means 121, the first housing 118 of the pressure control device 108 is suspended such that the pressure control device 108 is mounted in a positionally fixed manner. In the closing means 117, on the side proximal to the first chamber 124, a space 123 is recessed, in which the second housing 152 can be secured with a slightly clamping fit, such that the counter-coupling means 150 extend at a slight distance from the further coupling means 148. The axial bore 198 is then likewise located at a slight distance from the rod-shaped element 196. In this position, the valve 194 cannot be energized, at least cannot be opened, so that no gas can flow from the first chamber 124 to the inner space 104.

In the closing means 117, a discharge channel 125 is included, which at one end is connected to the cavity 123 and at the other end can be connected to, for instance, a hose 127 which can be connected to a tapping device or the like. In the cavity, a series of ribs 128 are provided, which keep the end wall 156 of the second housing 152 spaced from the walls of the cavity 123, both in axial and in radial direction. Accordingly, during use, beverage 2 can flow past the second housing 152 to the discharge channel 125, regardless of the position of the closing means 117.

To make the pressure control device 101 ready for use, in a container 101 according to FIG. 3 only the closing means 117 needs to be moved in the direction of the inner space 104, thereby pressing the second housing 152 fixedly onto the first housing 118 by means of the coupling means 148, 150. At the same time, the axial bore 198 is thereby pushed over the rod-shaped element 196. This ready-for-use condition is shown in FIG. 3B. The closing means 117 can then be moved back upwards, but can optionally be secured in the depressed position. In the condition shown in FIG. 3B, the pressure in the inner space 104 will be controlled depending on the control pressure in the second chamber 160 and the pressure in the third chamber 162, in the manner described hereinbefore.

In a variant, not shown, of the embodiment according to FIG. 3, the closing means 117 comprises a valve which closes the discharge channel 125 in the condition shown in FIGS. 3A and 3B, i.e., the extreme upwardly moved condition. This valve is automatically opened when the closing means 117 in FIG. 3A or B is pushed down. The advantage thereby achieved is that the closing means 117 can at the same time function as tap 116. The discharge channel 125, however, can also be omitted when another tap is provided, for instance as shown in FIG. 1.

Also, in an embodiment as shown in FIG. 3, the piston can be connected with the rod-shaped element 196, such that prior to activation the chamber 160 is relatively large, and is reduced only when the closing means 117 is pressed down.

Figure 4:
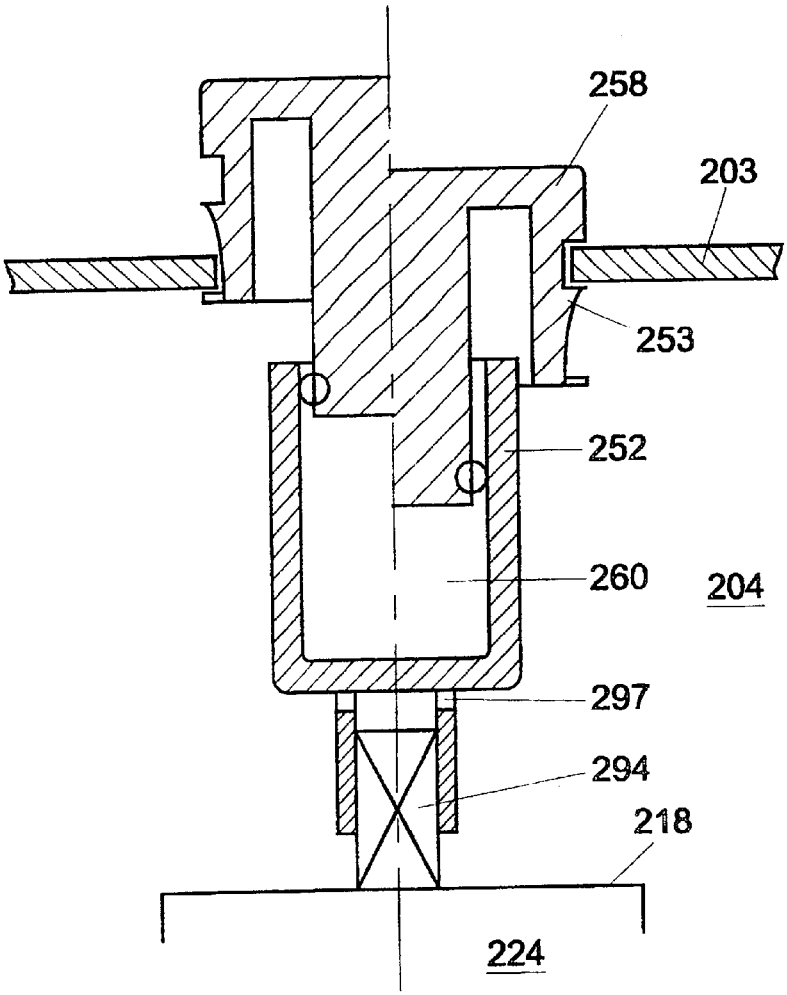
FIG. 4 shows in sectional side elevation a detail of a pressure control device in an alternative embodiment.

FIG. 4 shows an alternative embodiment, in which the housing 252 for the second chamber 260 is connected with the valve 294, while the piston 258 extends into the open end of the housing 252 remote from the first chamber 224 and can be secured in two positions with respect to the wall 203 of the container. In FIG. 4, on the left-hand side, the piston 258 is secured in an upper position, so that the second chamber 260 is relatively large and substantially pressureless, such that the housing 252 will remain stationary. By pressing the piston 258 down into the position shown on the right-hand side in FIG. 4, in which it is retained on the wall 203 by means of fingers 253, the volume of the second chamber 260 is reduced considerably, so that a desired control pressure is obtained therein. A change of the pressure in the inner space 204 to a value below the control pressure will presently result in the housing 252 moving away from the piston 258, in downward direction, thereby operating the valve 294 for release of gas from the first chamber 224.

Figure 5:
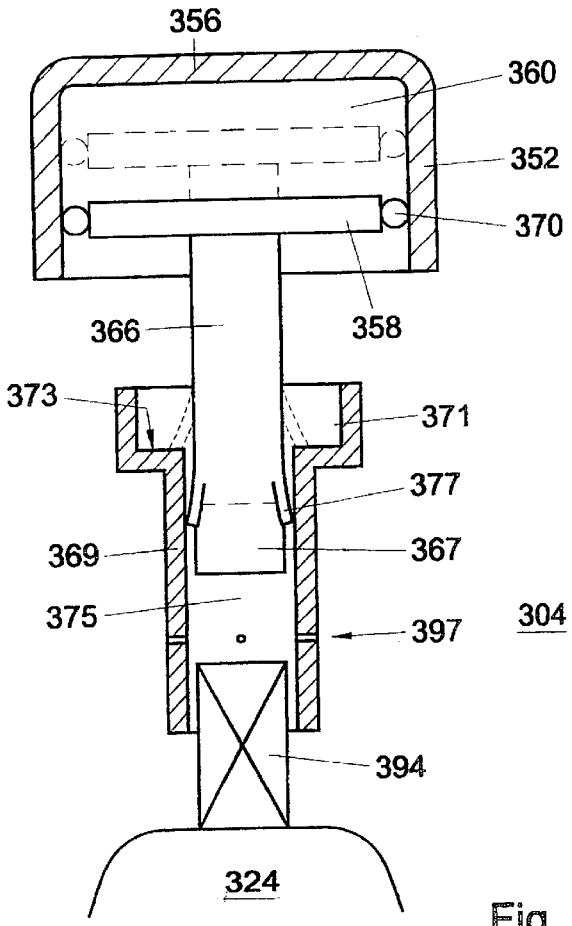
FIG. 5 shows in sectional side elevation a detail of a pressure control device in a second alternative embodiment.

FIG. 5 shows an embodiment of a control device according to the invention in which a first chamber 324 is equipped with a valve 394, being a male valve in the embodiment shown. It will be clear, however, that this may also be a female or tilting valve. A second chamber 360 is provided in a housing 352, in which a piston 358 is received with a proper fit, along with a sealing O-ring 370. A stem 366 is fixedly connected with the piston 358 and extends in the direction of the valve 394. The free end 367 of the stem 366 is clear of the valve 394. A substantially cylindrical intermediate part 396 has a first end secured on the valve 394 and has its circumferential wall provided with a number of passage openings 397 for forming a fluid connection between the first chamber 324 and the third chamber 304 when the valve is opened. The intermediate part 396 is provided, adjacent the open second end remote from the first chamber, with a widened portion 371 with a shoulder 373. The free end 367 of the stem 366 extends into the bore 375 of the intermediate part 369 and is provided with outwardly biased resilient fingers 377. In the first position shown in FIG. 5, the fingers 377 rest against the inside of the narrower portion of the bore 375, between the valve 394 and the shoulder 373. This means that the piston 358 can move freely over a pre-selected distance, which distance is determined, on the one hand, by the minimum distance between the free end 367 and the valve 394 and, on the other hand, by the position of the fingers 377 and the shoulder 373. In fact, when the piston 358 is moved further within the housing 352 in the direction of the end wall 356, as far as or beyond the position represented in broken lines, the free ends of the fingers 377 end up above the shoulder 373 and will spring outwardly, such that upon subsequent downward movement of the piston 358, they will engage the top surface of the shoulder 373. The fingers 377 and the shoulder 373 thus form first and second coupling means. When the piston 358 is moved down from the position represented in broken lines, then, as a result of an increase of the volume of the second chamber 360, the intermediate part 369 will be moved down along with it and the valve 394 will thereby be opened.

From the position of the piston 358 shown in solid lines in FIG. 5, which does not permit operation of the valve 394, it can be brought into a position of use by an activation step. To that end, for instance, the pressure in the third chamber 304 is temporarily raised from outside, such that the piston 358 is moved up to the position represented in broken lines, whereby the control pressure in the second chamber 360 is at least approximated. As a result, the fingers 377 are moved to above the shoulder 373, and the active position of use is achieved. It will be clear that this can also be achieved, for instance, by mechanically pulling the piston 358 up into the position represented in broken lines, or in any other suitable manner.

Figure 6:
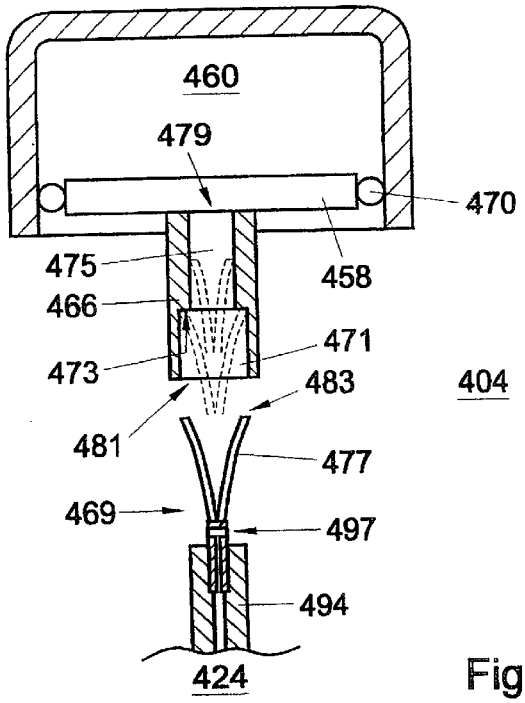
FIG. 6 shows in sectional side elevation a detail of a pressure control device in a third alternative embodiment.

FIG. 6 schematically shows an alternative embodiment, where in the stem 466 the bore 475 is provided, which stem 466 is connected with the piston 458, such that the bore 475 has a blind end 479. Adjacent the open end 481, the bore 475 is provided with a widened portion 471, such that a shoulder 473 is formed at a distance from the blind end 479. An intermediate part 469 has a first end secured in a valve 494, female in this example, and is provided with a passage 497 for forming a fluid connection between the first chamber 424 and the inner space 404 of the container when the valve is open. The intermediate part 469 is provided with outwardly biased resilient fingers 477. When the free ends of the fingers 477 are pinched together, they can be slipped into the relatively narrow portion of the bore 475 between the blind end 479 and the shoulder 473, where the fingers 477 can move freely in the longitudinal direction, so that movements of the piston 458 are permitted without the valve 494 being operated. Only when the piston is moved such that the volume of the chamber 460 is reduced considerably and the free ends 483 of the fingers 477 are moved to below the shoulder 473 can the fingers 477 expand such that the free ends 483 can engage the shoulder 473. In this position, a movement of the piston 458 in the direction of the valve 494 results in the intermediate part 469 being pressed down along with it, thereby opening the valve 494. The first and second position of the first and second coupling means formed by the stem 466, at least the shoulder 473, and the intermediate part 469, at least the fingers 477, are represented in broken lines in the first, uncoupled position and second, coupled position.

Figure 7:
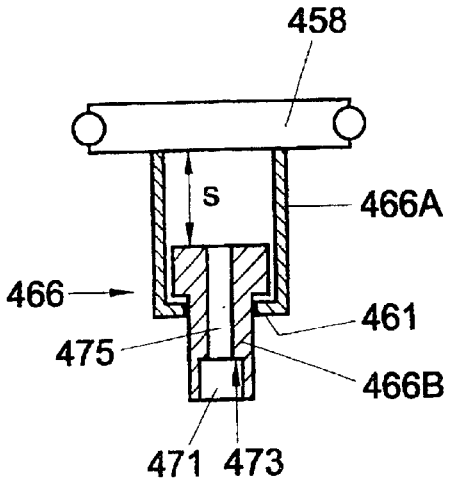
FIG. 7 shows a portion of a pressure device according to FIG. 6, in an alternative embodiment.

FIG. 7 shows a portion of a control means according to FIG. 6, where the piston 458 has a stem 466 which is divided into two parts 466A, 466B. The first, cylindrical part 466A is fixedly connected with the piston 458 and is provided at the free end with an inwardly extending flange 461 with an opening. Through the opening extends the second part 466B of the stem 466, which is provided, at the end located within the first stem part 466A, with a widening which provides for proper guidance and moreover butts against the flange 461 when the second stem part 466B has been moved down maximally. In the second stem part 466B, a bore 475 is provided having a widening 471 adjacent the outer free end, thereby forming a shoulder 473. The fingers 477, not shown in FIG. 7, of the intermediate part 469 as shown in FIG. 6 can again be received in the bore 475 in the first and second position referred to. In this embodiment, the advantage achieved is that the piston 458 acquires a greater free movement with the coupling means 477, 473 in the first position, disallowing operation of the valve 494, since the second stem part 466B can move freely relative to the first stem part 466A over the distance S. Only when the inner end of the second stem part 466B rests against the piston 458A and the fingers 477 rest against the shoulder 473 can the valve 494 be operated.

Figure 8:
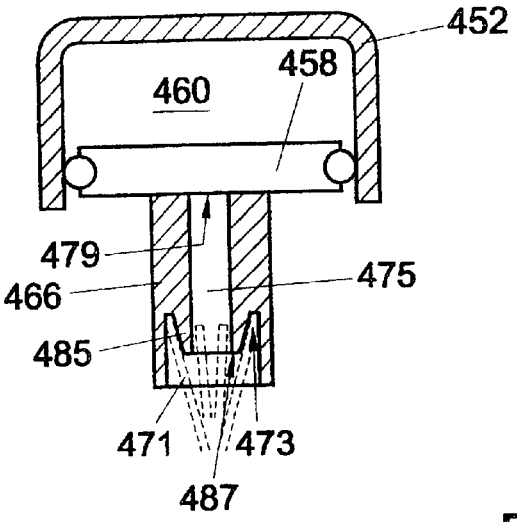
FIG. 8 shows a portion of a pressure device according to FIG. 6, in a fifth alternative embodiment.

FIG. 8 shows a further alternative embodiment of a piston 458 with stem 466 for use in a pressure control device according to FIG. 6. In the widened portion 471 of the bore 475, a ridge 485 extends from the shoulder 473 in the direction away from the piston 458 and the blind end 479 of the bore 475, which ridge 485 is included within the widened portion 471. In this embodiment, the free ends 483 of the fingers 477 will have to pass the edge 487 of the ridge 485 in order to be brought from the first, uncoupled position to the second, coupled position to be able to rest against the shoulder 473. The advantage thereby achieved is that the piston 458 will have to be moved relative to the housing 425 over a relatively great distance, i.e., the volume of the second chamber 460 will have to be reduced considerably, clearly further than is necessary for the desired control pressure. This means that the chance of undesired activation is reduced considerably, which enhances safety still further.

Figure 9:
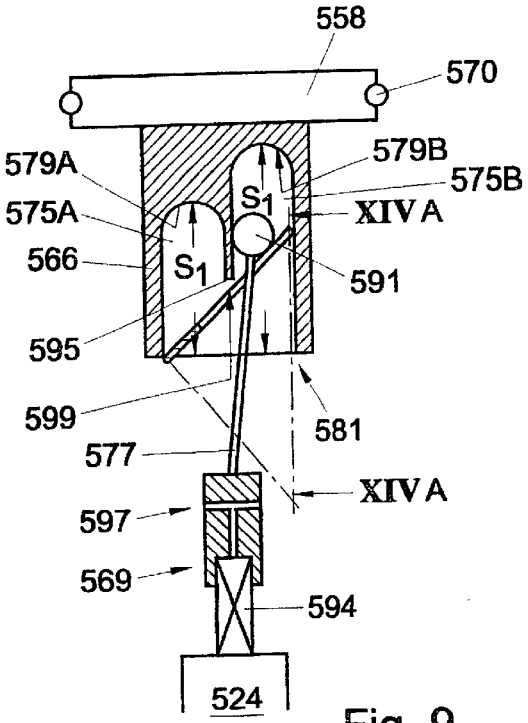
FIGS. 9 and 9A show a portion of a pressure device according to FIG. 6, in a sixth alternative embodiment.
Figure 9A:
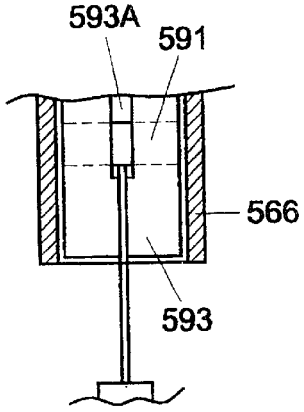

FIGS. 9 and 9A show, in cutaway side elevation and partial front view, a further alternative embodiment of control means for a container according to the present invention. In this embodiment, on the valve 594 of the first chamber 524, an intermediate part 569 with passage 597 is secured, on which intermediate part a resilient finger 577 is mounted. In the position shown in FIG. 9, the resilient finger 577 is optionally biased to the left, for reasons to be described further hereinafter. Attached to the piston 558 with piston ring 570 is a stem 566, provided with two bores located next to each other. In FIG. 9, the first bore 575A, located on the left-hand side, has a depth $S_1$, the second bore 575B, located on the right-hand side, has a depth $S_2$, which is greater than depth $S_1$. The depth has been determined starting from the open end 581 of the bores 575, remote from the piston 558. The resilient finger 577 is provided, at the free end, with a head 591, designed as a cross-stick in the embodiment shown. The first bore 575A is separated from the second bore 575B by a partition 595 which terminates at a distance from the open end 581. Adjacent to the open end 581 of the bore, a somewhat flexible flap 593 is connected on the side of the first bore 575A and extends at a slant up against the opposite wall of the second bore 575B. Provided in the flap 593 is a slot 593A through which the finger 577 can extend. The head 591 then rests against the side of the prongs of the fork-shaped flap 593 proximal to the piston 558.

In FIG. 9, the first, uncoupled position is shown, in which the head 591 extends in the second bore 575B, between the blind end thereof and the flap 593. The piston 558 can then move freely over a height which is determined by the distance between the free edge 599 of the partition 595 and the blind end 579B of the second bore 575B. When the piston 558 is moved upwards so far that the head 591 extends under the free edge 599, it will be guided into the first bore 575A by the flap 593. If subsequently the piston 558 is moved down again, the head 591 will be received in the first bore 575A and butt against the blind end 579A of the first bore 575A, so that the coupled second position is obtained. Upon further downward movement of the piston 558, the valve 594 will be operated via the finger 577. The flap 593 prevents the possibility of the head 591 being released from the bore 575. Moreover, the flap 593 is located so close to the edge 599 of the partition 595 that the head 591 will not be easily moved between them when the head moves up along the flap 593. The head 591 is thereby prevented from moving back into the second bore 575B. It is noted, incidentally, that when the finger 579 is sufficiently biased in the direction of the first bore 575A, the flap 593 can optionally be omitted.

Figure 10:
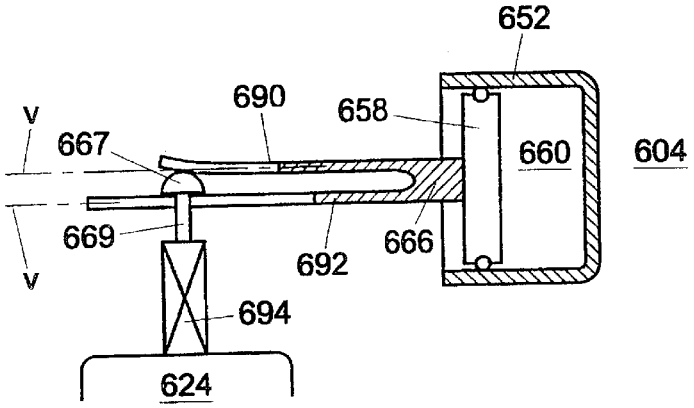
FIGS. 10 and 10A show a portion of a pressure device according to FIG. 6 in a seventh alternative embodiment.
Figure 10:
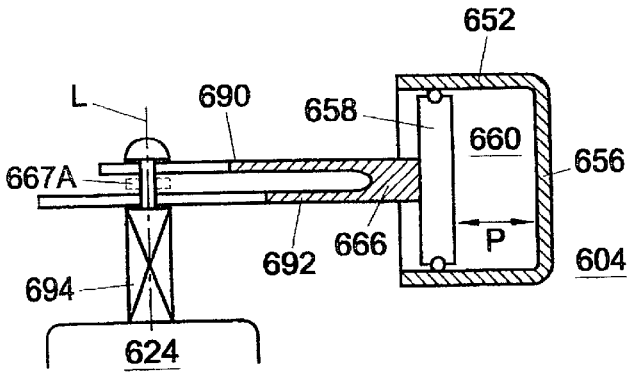
Figure 10A:
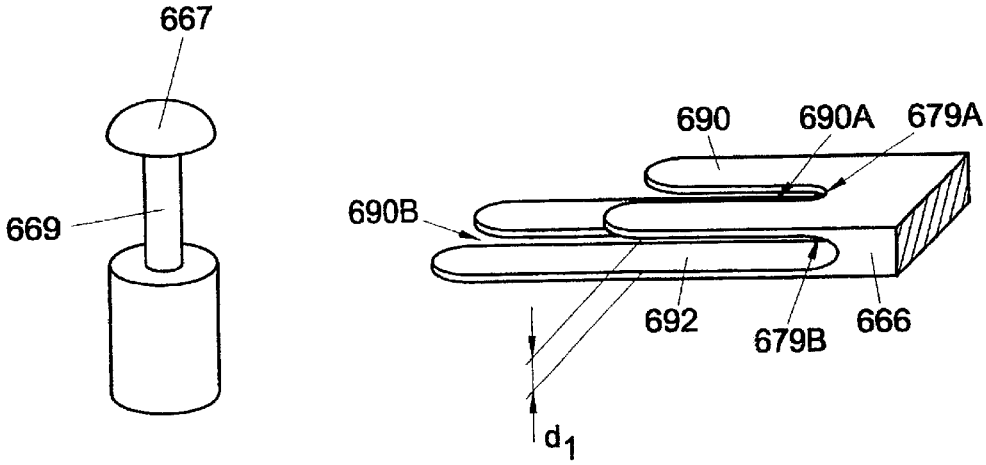

FIGS. 10 and 10A show in partial sectional side elevation and in perspective view, respectively, a further alternative embodiment of an operating device according to the invention, suitable in particular for use with a tilting valve. Such tilting valves, by which a passage opening can be opened or closed by tilting an operating stem, are known from practice and are not further discussed here. In this embodiment, the tilting valve 694, connected with the first chamber 624, is provided with an operating stem 669 with a widened head 667. The head 667 has a preferably convex top. In the housing 652 of the second chamber 660, a piston 658 is received, on which a stem 666 has been secured. The piston 658 has a direction of travel P, which extends at an angle, and preferably at right angles, relative to the centerline L of the tilting valve 694 and the operating stem 669. The stem 666 of the piston 658 is provided with a first fork 690 and a second fork 692. In FIG. 10A, in perspective view, the stem 666 with the first fork 690 and the second fork 692 is represented, together with the operating stem 669 with its widened head 667. The first and second forks 690, 692 are located in parallel planes, at some distance from each other. In the neutral position shown in FIG. 10A, this distance is indicated by $D_1$. Each fork 690, 692 comprises two prongs with an intervening slot 690A and 690B, respectively, which slots are open at the end remote from the piston 658. The slots 690A, B have a width greater than the thickness of the operating stem 669, but smaller than the width of the head 667. Accordingly, the two forks 690, 692 can be slipped between the valve 694 and the head 667 over the operating stem 669. The first fork 690 is shorter than the second fork 692, as are the slots provided therein. The closed end 679A of the first slot 690A lies at a distance from the piston 658 greater than the distance between the piston and the closed end 679B of the second slot 690B.

In FIG. 10, in the upper portion, the operating device is shown in an uncoupled first position, where the first fork 690, elastically deformed to some extent, rests against the top of the knob 667. The materials and the deformation of the fork have been selected such that the movement of the piston 658 in the direction P is possible without the operating stem 669 thereby being carried along. From this position, the device can be activated by displacing the piston 658 in the direction of the end wall 656, such that the free end of the first fork 690 can pass the head 667. Elastic deformation stress in the first fork 690 will then ensure that it returns to the plane V, such that it will extend under the underside of the head 667. As a result, upon return of the piston 658 in the direction of the valve 694, the operating stem 669 will be received in the first slot 690A. Upon further movement of the piston 658 in the direction away from the end wall 656, upon increase of the volume of the chamber 660, the blind end 679A will butt against the operating stem 669 and, upon further movement, carry along the operating stem 669, so that it is tilted relative to the longitudinal axis L referred to above. The tilting valve 694 will thereby be opened, and gas can flow from the first chamber 624 to the inner space 604. Upon increase of the pressure in the inner space 604, the piston 658 will move back, the second chamber 660 thereby being reduced, so that the tilting valve 694 can return to its closed position. Optionally, on the operating stem 669, between the valve 624 and the head 667, a guide ring 667A can be provided, represented in FIG. 10 in broken lines, such that at least the second fork 692 is guided between the valve 694 and the guide ring 667A, so that a still better positioning is obtained.

Figure 11:
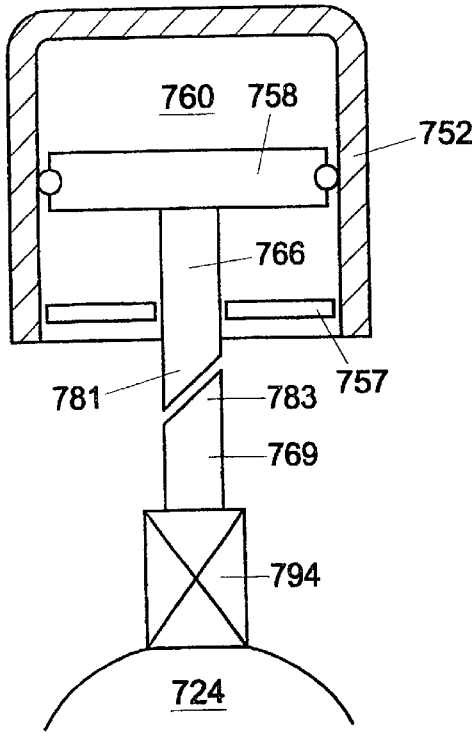
FIG. 11 shows a portion of a pressure device according to FIG. 6 in an eighth alternative embodiment, suitable in particular for use with tilting valves.

FIG. 11 shows a simple embodiment of a device according to the present invention for operating a tilting valve 794. In this embodiment, the piston 758, which bounds the second chamber 760 within the housing 752, comprises a stem 766 with a beveled free end 781. On the tilting valve 794 on the first chamber 724, a coupling part 769 is provided with a likewise beveled free end 783. The stem 766 is guided within the housing 752 by a guide 757. Upon enlargement of the second chamber 760 the stem 766 is moved down, in the direction of the tilting valve 794. The cooperating beveled ends 781, 783 will ensure that the tilting valve 794 is tilted from the closed position to an open position. Such a solution can also be readily utilized in exemplary embodiments shown hereinabove when tilting valves are used instead of valves or operating means shown there.

Figure 12:
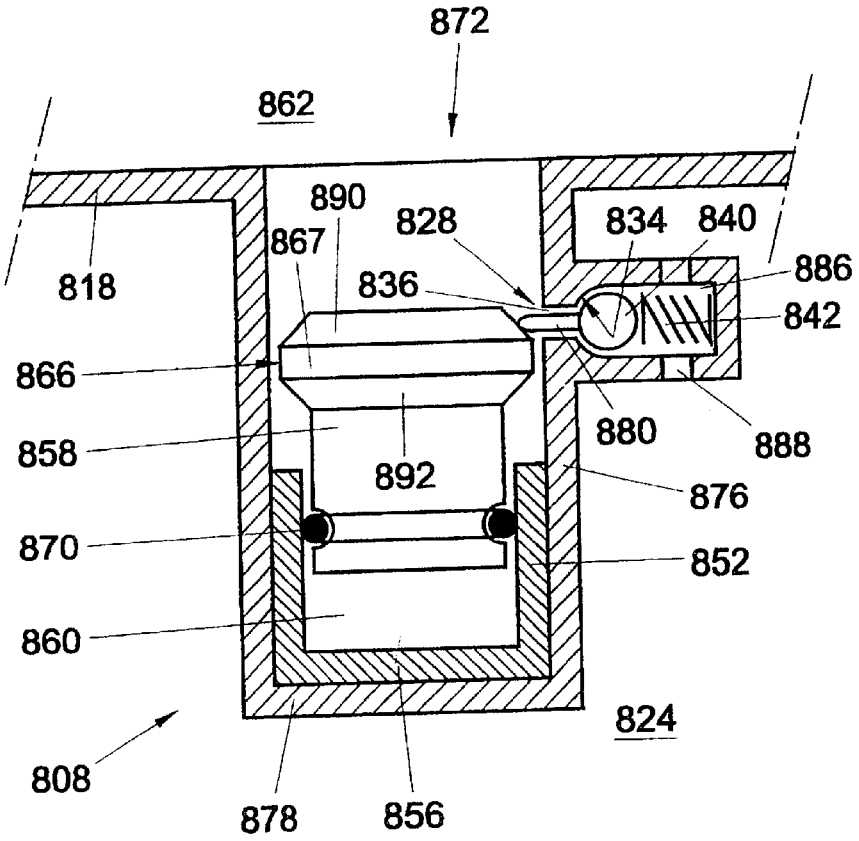
FIG. 12 shows a further alternative embodiment of a pressure control device according to the invention.

FIG. 12 shows a further alternative embodiment of a pressure control device 808 according to the invention. In this embodiment, in a recess 872 in the first housing 818, a passage opening 828 is provided, with an axial bore 836. A closing member 840 in the form of a ball is urged against the seating 834 by biasing means 842, with a pin 880 extending from the closing member 840 through the axial bore 836 into the recess 872. The biasing means 842 and the closing member 840 are received in a fourth chamber 886 with inflow openings 888 terminating in the first chamber 824. As a consequence, the recess 872 can be located at a relatively great distance from the wall of the first housing 818. In this embodiment, the second housing 852 is accommodated in the recess 872, such that it has the end wall 856 resting on the bottom 878 of the recess. In this embodiment, the piston 858 is designed as a cylinder with an outer circumference approximately corresponding with the inner circumference of the second housing 852, with interposition of a fitting piston ring 870 or like gas-tight and liquid-tight sealing means. Between the piston 858 and the end wall 856, again the second chamber 860 is formed. At the end of the piston 858 remote from the second chamber 860, a control means 866 is included, designed as a disc 867 with frustoconical edges 890, 892. This disc 867 has an outside diameter which, for instance, corresponds approximately with the inside diameter of the recess 872, while the smallest diameter of the frustoconical edges 890, 892 is approximately equal to the diameter of the piston 858.

With the piston 858 in a neutral position, i.e., in an uncoupled position, with a low pressure prevailing in the second chamber 860, the lower conical edge 892 is disposed against the upper side of the pin 880. Accordingly, the closing member 840 cannot be operated by the piston 858, since it is pushed outwards by the spring 842. When in the third chamber 862 at least temporarily the pressure is raised considerably, the piston 858 will be pushed downwards, thereby reducing the second chamber 860 and raising the pressure therein. The piston 858 will then be pushed past the pin 880, temporarily pressing it away, counter to the spring 842. After the piston 858 has passed, the closing member 840 will be pushed back into the closing position. Thus, the control device 808 is activated. When the pressure in the third chamber 862 decreases again to below the control pressure, the piston 858 will be pushed away upwardly, thereby pushing away the pin 880 and hence the closing member 840, counter to the spring 842, thereby forming a fluid connection between the first chamber 824, the opening 888, the fourth chamber 886 and the outflow opening 828, for raising the pressure in the third chamber 862 and hence in the inner space of the container. When the pressure in the inner space has been raised again sufficiently, the piston 858 will be pushed back again into the position shown in FIG. 12, and the closing member is closed again.

In principle, operating devices according to the present invention have as an important additional advantage that upon fall-out of the control pressure in the second chamber, for instance through leakage, the operating means is forced to a closed position, so that gas is simply and effectively prevented from uncontrollably flowing from the first chamber to the third chamber and giving rise to excessive pressure in the container, at least in the third chamber. Thus, the safety of a container according to the present invention, at least of a pressure control device to be used therein, is enhanced still further.

What is claimed is:

1. A container with pressure control device for maintaining a substantially constant, pre-set pressure in the container, the container being arranged for dispensing a fluid, the pressure control device comprising a first chamber for containing a pressure fluid, in particular a pressure gas, a second chamber in which at least during use a control pressure prevails, and a third chamber which is formed by or is in communication with, at any rate is at least partly included in an inner space of the container, while between the first chamber and the third chamber a passage opening is provided in which a closing member is included for closing the passage opening during normal use when the pressure in the third chamber is higher than the control pressure, while a control means is movable by a displaceable or deformable part of the wall of the second chamber and is arranged for at least partly displacing the closing member when the pressure in the third chamber is lower than the control pressure, such that the pressure fluid can flow under pressure from the first chamber to the third chamber, characterized in that prior to use the control means have been brought into a position in which they are at least functionally uncoupled from the closing member, and the pressure control device is arranged for functionally coupling the control means to the closing member through an activation step prior to use.

2. A container according to claim 1, wherein the control means comprise a first part and a second part, the first part being connected with the closing member and the second part being connected with the displaceable or deformable wall part of the second chamber, the first and second part comprising first and second coupling means which can be brought into a first position in which said wall part is freely movable relative to the closing member and into a second position in which the coupling means are coupled such that the closing member can be moved through movement or deformation of said wall part.

3. A container according to claim 2, wherein the first coupling means comprise a number of outwardly biased resilient elements, the second coupling means comprising a bore, said bore being at least partly wider adjacent an open end than adjacent the opposite end, such that a shoulder is formed at a distance therefrom, the resilient elements in the first position resting against the inside of the bore between the shoulder and the narrower end and in the second position resting against the side of the shoulder proximal to the open wide end.

4. A container according to claim 2, wherein the first coupling means are connected with the first part.

5. A container according to claim 2, wherein the closing member is formed by a tilting valve, the first coupling means comprising a rod-shaped element connected with the tilting valve and having a widened head, and the second coupling means comprising a fork-shaped element having at least two prongs and an intervening slot, said slot having a width greater than the width of the rod-shaped element, but smaller than the widened head, while in the first position the prongs of the fork-shaped element are located on the upper side of the widened part, slightly biased in the direction of the head, and can move freely thereover without tilting the valve, and in the second position the rod-shaped element is received in the slot, such that the prongs are located between the widened head and the tilting valve, such that through movement of said wall part the closed end of the slot can be moved against the rod-shaped element for tilting the tilting valve.

6. A method for making a container ready for dispensing a fluid under substantially constant pressure, wherein a can-shaped holder is provided with a first part of a pressure control device, which first part comprises at least a closing member which is biased into a closed position and can be opened by an overpressure applied thereto from the outside; wherein a fluid, in particular a gas, is introduced into the holder under relatively high pressure and upon removal of the overpressure the closing member is brought into said closed position, whereafter on the first part a second part of the pressure control device is arranged, which second part comprises control pressure-controlled control means which force the closing member, at least during use, counter to said bias, to an opened position when in the environment of the holder a pressure prevails which is lower than said control pressure; wherein the holder with coupled first and second part is introduced into the container, which container is filled with a fluid to be dispensed and is subsequently closed, while the control means are actively functionally coupled to the closing member by means of an activation step.

7. A method according to claim 6, wherein the second part is included in, at least adjacent to, closing means for the container, the first part is mounted in the container at a slight distance from the second part, and when the container is closed, the second part is movable to a cooperative position with the first part, such that through said movement of said second part the pressure control device is set into operation.

8. A method according to claim 7, wherein the second part is mounted in or adjacent to dispensing means for the fluid, and through said movement of the second part the dispensing means are set into operation, at least are made ready for use.

9. A method according to claim 7, wherein prior to use at least temporarily an overpressure is applied in the inner space of the container, such that the control means are actively functionally coupled to the closing member.

10. A method according to claim 9, wherein control means are used with a second chamber at least partly defined by a movable wall part, wherein in the second chamber during use a control pressure is set, wherein prior to use by raising the pressure in the inner space of the container the volume of the second chamber is considerably reduced and the pressure therein is raised to above the control pressure, such that first and second coupling means of the control means and the closing member are moved from a functionally uncoupled position to said functionally coupled position.

11. A container according to claim 3, wherein the first coupling means are connected with the first part.

* * * * *